US006691402B2

(12) United States Patent
Chang

(10) Patent No.: US 6,691,402 B2
(45) Date of Patent: Feb. 17, 2004

(54) MOLD STRUCTURE OF AN EXTRUSION TOOL FOR EXTRUDING AND SEALING A CONNECTOR

(76) Inventor: Chi-Fu Chang, No. 16, Alley 10, Lane 187, Sec. 1, Li-Nung St., Peito District, Taipei (TW)

( * ) Notice: Subject to any disclaimer, the term of this patent is extended or adjusted under 35 U.S.C. 154(b) by 0 days.

(21) Appl. No.: 09/887,075

(22) Filed: Jun. 25, 2001

(65) Prior Publication Data

US 2002/0194726 A1 Dec. 26, 2002

(51) Int. Cl.[7] ..... H01R 43/042

(52) U.S. Cl. ..... 29/751; 29/748; 29/828; 425/408

(58) Field of Search ..... 29/751, 33 M, 29/747, 750, 755, 828; 425/408

(56) References Cited

U.S. PATENT DOCUMENTS 2,953,185 A * 9/1960 Lazar ..... 29/751

4,912,958 A * 4/1990 Yonkers ..... 72/410

* cited by examiner

*Primary Examiner*—Noah P. Kamen

(74) *Attorney, Agent, or Firm*—Troxell Law Office PLLC

(57) ABSTRACT

A mold structure of an extrusion tool for extruding and sealing a connector is disclosed. The mold structure is capable of being inserted into a mold supporting seat for receiving a coaxial cable; the mold structure clamping the coaxial cable. The mold structure has the following components. A seat is installed with a hole for receiving a coaxial cable. A chuck passes through the seat so that the chuck can move toward or leave away from the coaxial cable along an axial direction. A movable element is installed at one side of the seat for control an extent of movement of the chuck moving toward the coaxial cable along an axial direction. Thereby, the chuck moves toward or leaves from the axial direction; and the coaxial cable is clamped and fixed by a sufficient force.

4 Claims, 3 Drawing Sheets

MOLD STRUCTURE OF AN EXTRUSION TOOL FOR EXTRUDING AND SEALING A CONNECTOR

FIELD OF THE INVENTION

The present invention relates to a mold structure of an extrusion tool for extruding and sealing a connector, wherein a movable element controls the extent of movement of a chuck moving toward a coaxial cable along an axial direction. Thereby, the chuck moves toward or leaves from the axial direction; and the coaxial cable is clamped and fixed by a sufficient force.

BACKGROUND OF THE INVENTION

The coaxial cable connector is well known in the art. Typically, an F-type coaxial cable connector is threaded onto a complimentary interface connector to integrate the coaxial cables with various electronic devices, such as televisions, CB (Citizens Band) radios, FM (Frequency Modulation) radios, and wireless amateur radio systems into one unit.

The conventional coaxial cable includes a central conductor, a dielectric insulator covered on the central conductor, at least one layer of braided shield body disposed around the periphery of the dielectric insulator, and an outer cover shielded on top of the at least one layer of braided shield body. The conventional coaxial connector includes a joint body and an insertion component. The compressing and connection of the insertion component to the outer jacket cylinder of the joint body makes the outer jacket cylinder compress inwardly and deform to tightly conjoin with the coaxial cable. Since the soft materials of polyvinyl chloride used for the outer cover of the coaxial cable has been replaced by the stiff polyethylene materials, the free end of the polyethylene coaxial cable can not force the outer cover onto the coaxial connector to form connection through manual operation, but must be inserted to the coaxial connector by press-in tool. Then the insertion component will be compressed onto the outer jacket cylinder of the joint body by using the compressing tool to make one end of the coaxial connector shrink and conjoin with the stiff-jacketed cable. Therefore, this kind of operation requires extra cost, multiple installation tools, causes the inconvenience of carrying extra tools and needs to be improved.

The inventor of the present invention has disclosed an extrusion tool, such as that disclosed in U.S. Pat. No. 6,591,457, in that an extrusion tool for extruding and sealing a coaxial connector is disclosed. The mold supporting end of the extrusion tool has an extractable mold structure for suiting to various coaxial cables. By the mold structure, the hard skin of the coaxial cable can be clamped and fixed for extrusion.

As shown in FIG. 1, a mold structure for used in a PE coaxial cable is illustrated. The mold structure has two molds A and B and a buckle C. By the buckle C, the hard skin of the coaxial cable is clamped and fixed. However, many parts are necessary in this clamping way and thus the manufacturing cost is high. Besides, in the processes of extruding combining and taking out a product, many operating steps are required. Therefore, the overall operation procedures are complex.

SUMMARY OF THE INVENTION

Accordingly, the primary object of the present invention is to provide a mold structure of an extrusion tool for extruding and sealing a connector, wherein a chuck cause a cavity surface to engage the hard skin of the coaxial cable so that the distal joint and engaging element are extruded and combined between the push rod and the mold structure, thereby, one end of the distal joint F is reduced and connected to the coaxial cable.

To achieve above objects, the present invention provides mold structure of an extrusion tool for extruding and sealing a connector. The mold structure is capable of being inserted into a mold supporting seat for receiving a coaxial cable. The mold structure has the following components. A seat is installed with a hole for receiving a coaxial cable. A chuck passes through the seat so that the chuck can move toward or leave away from the coaxial cable along an axial direction. A movable element is installed at one side of the seat for controlling an extent of movement of the chuck moving toward the coaxial cable along an axial direction. Thereby, the chuck moves toward or away from the axial direction; and the coaxial cable is clamped and fixed by a sufficient force The various objects and advantages of the present invention will be more readily understood from the following detailed description when read in conjunction with the appended drawing.

DETAILED DESCRIPTION OF THE PREFERRED EMBODIMENTS

Figure 2:
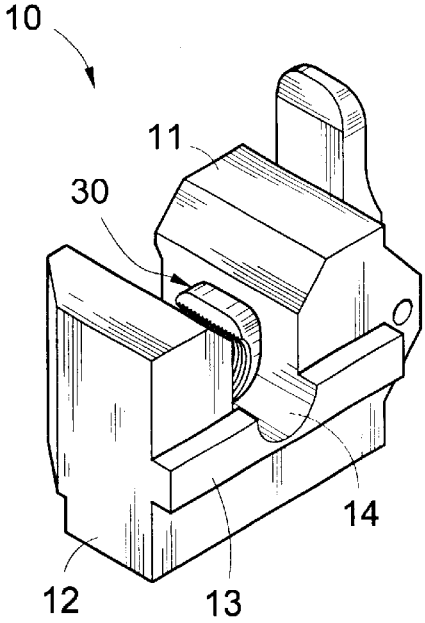
FIG. 2 is a perspective view of the mold structure according to the present invention.
Figure 1:
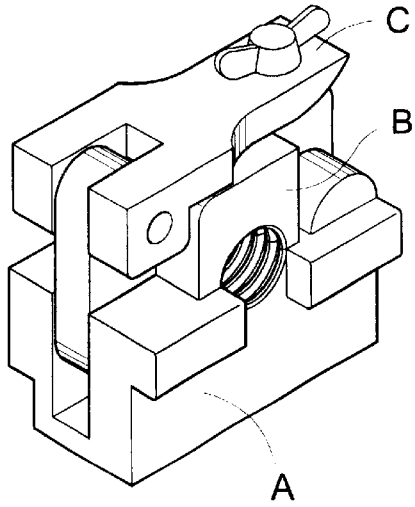
FIG.1 PRIOR ART
FIG. 1 is a perspective view of a prior art mold structure.
Figure 3:
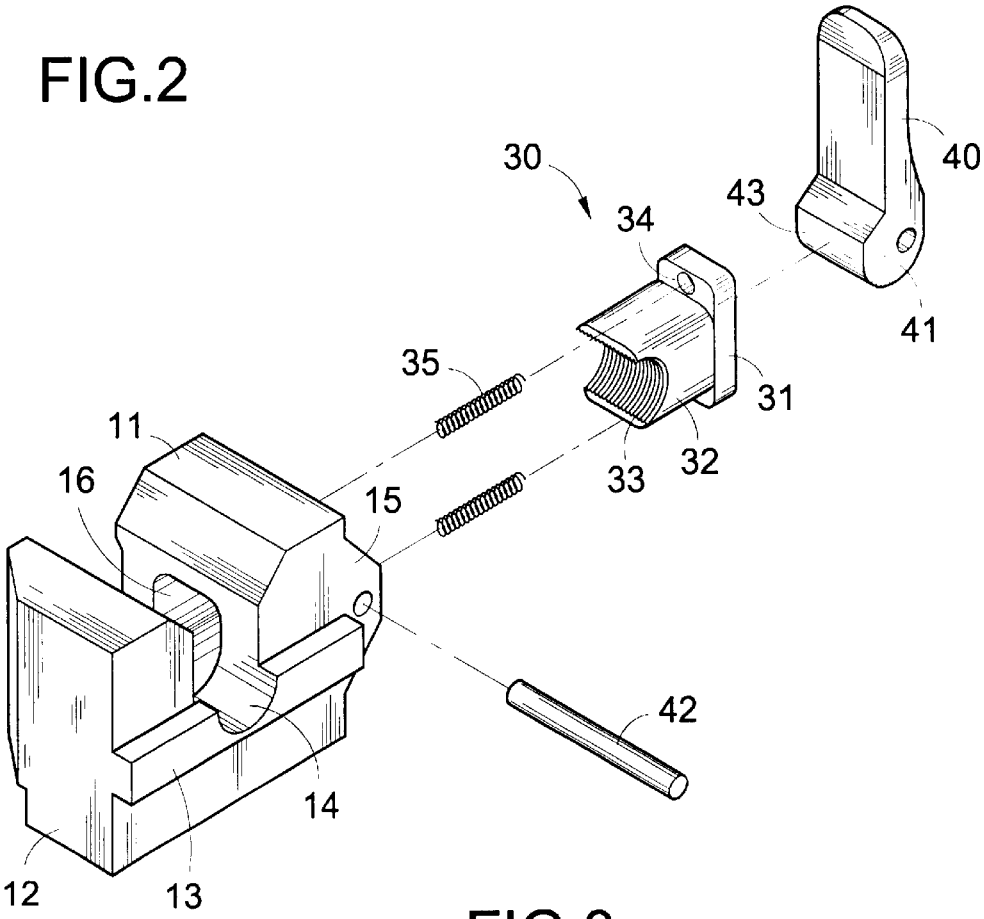
FIG. 3 is an exploded perspective view of the mold structure according to the present invention.
Figure 6:
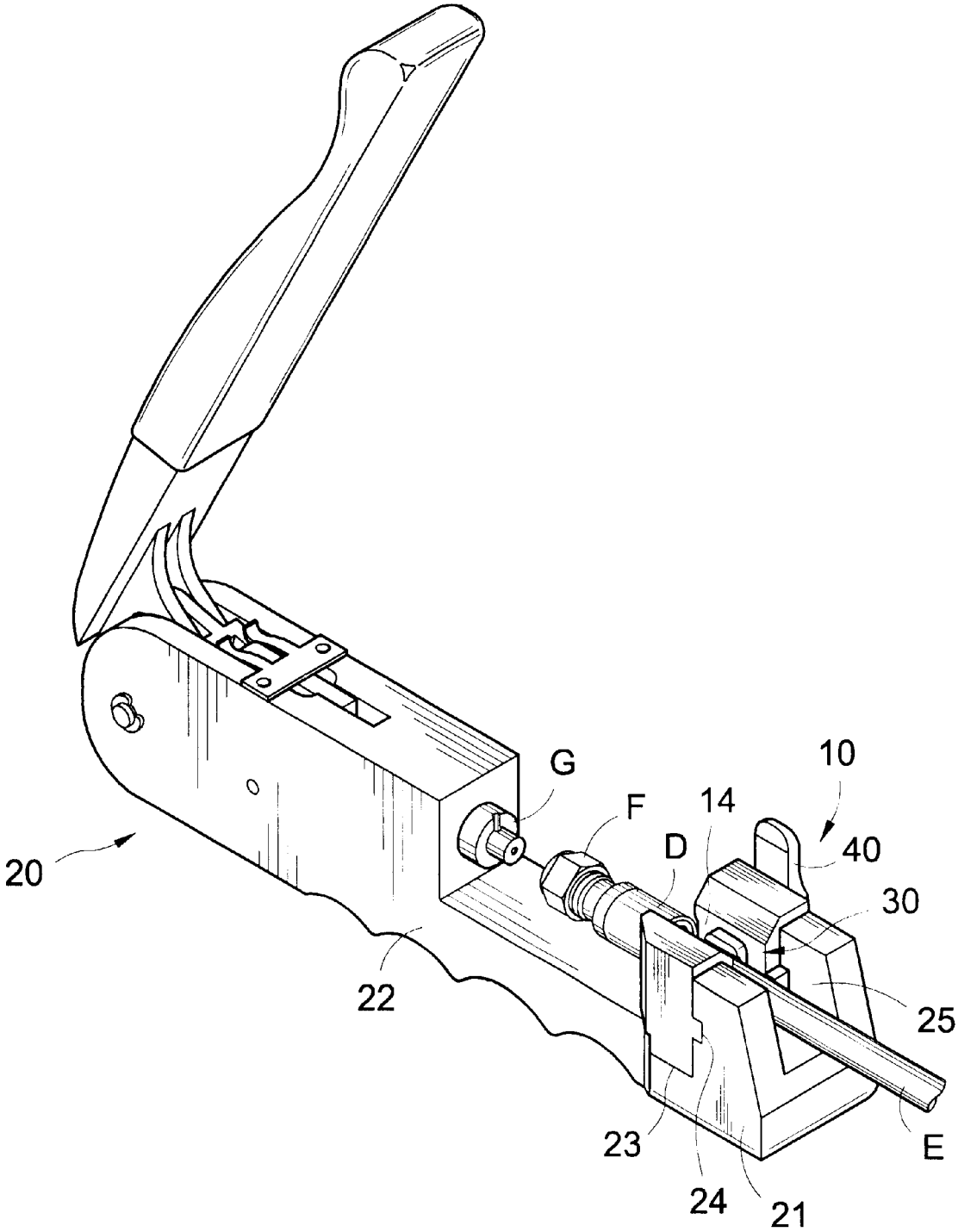
FIG. 6 is a perspective view showing that the mold structure of the present invention is assembly on an extrusion tool.

Referring to FIGS. 2, 3, and 6, the mold structure 10 of an extrusion tool for extruding and sealing a connector according to the present invention may be inserted to a mold supporting seat 21 of an extrusion tool 20. The mold supporting seat 21 is positioned at one end of a machine body 22.

The machine body 22 is installed with a seat 11 and a chuck 30. The seat 11 is installed with a protrusion 12 and a buckling block 13. The mold supporting seat 21 is installed with respective sliding groove 23 and recess 24 so that the mold structure 10 is inserted above the mold supporting seat 21. The protrusion 12 and buckling block 13 are arranged in the sliding groove 23 and recess 24 so that the two are matched properly.

The seat 11 has an opening 25 which is communicated to the hole 14 for receiving coaxial cable E. The opening 25 is positioned at one end of the machine body 22. The chuck 30 is slidable in the hole 16 of the supporting end 15. The mold supporting end 15 is installed at one side of the seat 11. A movable element 40 is installed is installed at the supporting end 15. One end 41 of the movable element 40 is firmly secured to one end of the supporting end 15. The movable element 40 is installed above the supporting end 15 by a supporting shaft 42 and the shaft 42 is utilized as a rotating center. The end 41 of the movable element 40 is installed with a shift surface 43 at the front end thereof which may adhere to or separate from the chuck 30 so that the chuck 30 moves along the positions illustrated in FIGS. 4 and 5.

The chuck 30 has a base portion 31 on which a clamping portion 32 is installed. The clamping portion 32 has a cavity surface 33 having a slightly semicircle shape. The cavity surface 33 is a threaded surface for being engaged to the hard skin of a coaxial cable, thereby, assuring that the hard skin of the coaxial cable is firmly secured.

The base portion 31 is installed with two holes 34 each being installed with a spring 35. Thereby, the movable element 40 can be moved to push the chuck 30 to move forwards so as to proper match the hard skin of the coaxial cable and a proper gap is installed therebetween. Then the spring 35 is extruded to be in a compressing condition.

Figure 4:
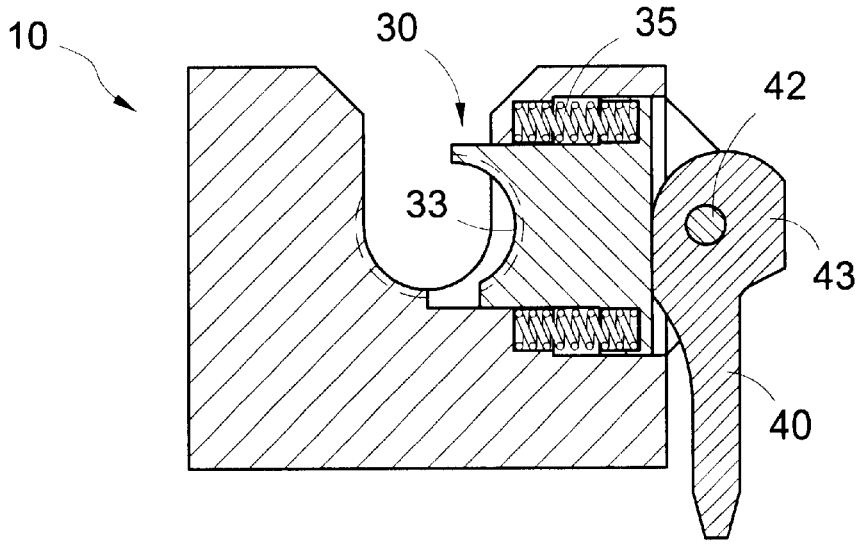
FIG. 4 is a cross sectional view of the mold structure of the present invention, in which the mold structure is at an opening position.
Figure 5:
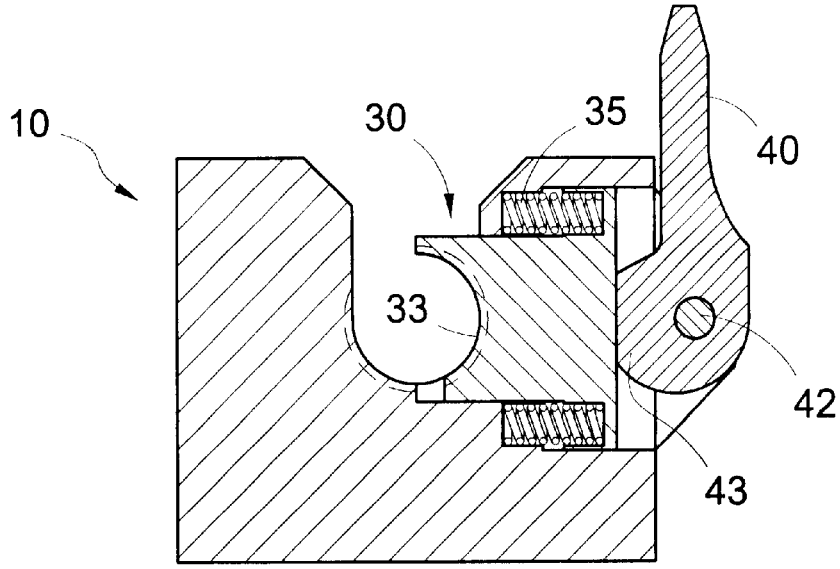
FIG. 5 is a cross sectional view of the mold structure of the present invention, in which the mold structure is at a closing position.

Referring to FIGS. 4 and 6, the extruding and combining steps of the distal joint and engaging element are illustrated. At first, the engaging element D is engaged with the coaxial cable. One end of the coaxial cable E is inserted into the distal joint F and then passes through hole 14 of the mold structure 10. The movable element 40 is moved upwards (referring to FIG. 5) around the supporting shaft 42 (referring to FIG. 4) so that the shift surface 43 of the movable element 40 moves the chuck 30 forwards around the center of the supporting shaft 42 with an eccentric distance. Then the spring 35 is extruded to be in a compressed condition. However, the forward moving chuck 30 cause the cavity surface 33 to engage the hard skin of the coaxial cable E so that the distal joint F and engaging element D are extruded and combined between the push rod G and the mold structure 10, thereby, one end of the distal joint F is reduced and connected to the coaxial cable E.

On the contrary, if a product is desired to be taken out, the movable element 40 is moved downwards so that the chuck 30 is not confined by the shift surface 43. By the elastic force of the spring 35, the chuck 30 moves from the coaxial cable E along an axial direction to reduce to the original position (referring to FIG. 4).

In summary, the manufacturing cost of the mold structure 10 of the present invention is lower. After extruding by the extrusion tool, the thumb may move the movable element 40 downwards synchronously to take out the product. Therefore, the operation procedure of the operator is reduced and the working efficiency is improved.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A mold structure for an extrusion tool for extruding and sealing a connector on a coaxial cable, the extrusion tool including a mold supporting seat, the mold structure comprising:

a) a seat having a first hole configured to accommodate a coaxial cable therein and a second hole;

b) a chuck on the seat and including a clamping portion movably mounted in the second hole and a base portion on the clamping portion, the clamping portion being movable between open and closed positions;

c) springs acting between the seat and the chuck so as to bias the clamping portion toward the open position; and, d) a movable element pivotally connected to the seat by a pivot shaft, the movable element having a shift surface eccentric to the pivot shaft and in contact with the chuck, whereby movement of the movable element about the pivot shaft moves the clamping portion toward the closed position.

2. The mold structure of claim 1 wherein the clamping portion includes a semi-circular cavity surface.

3. The mold structure of claim 2 wherein the cavity surface is a threaded surface.

4. The mold structure of claim 1 wherein the mold supporting seat has a recess and a sliding groove and wherein the seat further comprises a protrusion engaging the sliding groove and a block engaging the recess.

* * * * *